US010593277B2

(12) United States Patent
Ying et al.

(10) Patent No.: US 10,593,277 B2
(45) Date of Patent: Mar. 17, 2020

(54) VIEWING ANGLE MODE SWITCHING METHODS OF LIQUID CRYSTAL DISPLAY DEVICE AND LIQUID CRYSTAL DISPLAY DEVICE

(71) Applicant: Shenzhen China Star Optoelectronics Technology Co., Ltd., Shenzhen, Guangdong (CN)

(72) Inventors: Jianjian Ying, Guangdong (CN); Peng Du, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/744,683

(22) PCT Filed: Dec. 18, 2017

(86) PCT No.: PCT/CN2017/116863
§ 371 (c)(1),
(2) Date: Sep. 25, 2018

(87) PCT Pub. No.: WO2018/209948
PCT Pub. Date: Nov. 22, 2018

(65) Prior Publication Data

US 2019/0005909 A1 Jan. 3, 2019

(30) Foreign Application Priority Data

May 15, 2017 (CN) ..... 2017 1 0342668

(51) Int. Cl.
*G09G 3/20* (2006.01)
*G09G 3/36* (2006.01)

(52) U.S. Cl.
CPC ..... *G09G 3/3659* (2013.01); *G09G 3/20* (2013.01); *G09G 3/3648* (2013.01);
(Continued)

(58) Field of Classification Search
CPC ..... G09G 3/3659; G09G 3/3655; G09G 3/20; G09G 2320/068; G09G 2310/08;
(Continued)

(56) References Cited

U.S. PATENT DOCUMENTS

2009/0096954 A1* 4/2009 Sakai ..... G02F 1/1323 349/61
2012/0206436 A1* 8/2012 Nakata ..... G02F 1/134309 345/212
2016/0246146 A1* 8/2016 Yao ..... G02F 1/134309

FOREIGN PATENT DOCUMENTS

CN 103777422 A 5/2014
CN 104360555 A 2/2015
(Continued)

OTHER PUBLICATIONS

CN2017103426688 1st Office Action.

*Primary Examiner* — Towfiq Elahi
(74) *Attorney, Agent, or Firm* — Andrew C. Cheng

(57) ABSTRACT

The present invention provides a viewing angle mode switching method of a liquid crystal display device and the liquid crystal display device. A viewing angle mode switching request is received. The target view mode is a first viewing angle mode or a second viewing angle mode. A timing relationship between the second scanning signal and the first scanning signal is adjusted, according to the viewing angle mode switching request. The liquid crystal display device is instructed to switch between the first viewing angle mode and the second viewing angle mode, according to a change of the timing relationship between the second scanning signal and the first scanning signal. With implementing the embodiments of the present invention, switch between different viewing modes can be achieved, and the display convenience of the liquid crystal display device can be improved.

11 Claims, 7 Drawing Sheets

(52) U.S. Cl.
CPC ... *G09G 3/3655* (2013.01); *G09G 2300/0439* (2013.01); *G09G 2300/0447* (2013.01); *G09G 2310/08* (2013.01); *G09G 2320/068* (2013.01); *G09G 2358/00* (2013.01)

(58) Field of Classification Search
CPC ... G09G 2300/0439; G09G 2300/0447; G09G 2358/00; G09G 3/3648; G02F 1/1362; G02F 1/1323
See application file for complete search history.

(56) References Cited

FOREIGN PATENT DOCUMENTS

| | | | |
|---|---|---|---|
| CN | 104375343 | A | 2/2015 |
| CN | 104483789 | A | 4/2015 |
| KR | 20030008044 | A | 1/2003 |

* cited by examiner

VIEWING ANGLE MODE SWITCHING METHODS OF LIQUID CRYSTAL DISPLAY DEVICE AND LIQUID CRYSTAL DISPLAY DEVICE

BACKGROUND OF THE APPLICATION

This application claims the priority of an application No. 201710342668.8 filed on May 15, 2017, entitled "VIEWING ANGLE MODE SWITCHING METHOD OF LIQUID CRYSTAL DISPLAY DEVICE AND LIQUID CRYSTAL DISPLAY DEVICE", the contents of which are hereby incorporated by reference.

FIELD OF APPLICATION

The present disclosure relates to the field of display technology, and particularly to a viewing angle mode switching method of a liquid crystal display device and a liquid crystal display device.

DESCRIPTION OF PRIOR ART

At present, the liquid crystal display devices are widely used in various products. In order to meet the different requirements of the liquid crystal display devices in different occasions, the current display screens can compensate for different viewing angles of the liquid crystal display devices by compensating or weakening the viewing angles. For example, when meeting or sharing information, people want to see a liquid crystal display device from all angles of view, realize information sharing from different perspectives, and can use a liquid crystal display device with viewing angle compensation to realize a large-angle display. However, the inventor has found through research that in different scenarios, users have different requirements on the viewing angle of the same liquid crystal display device. For example, when a user uses a large viewing angle liquid crystal display device alone, he hopes to weaken the side view effect to protect personal privacy while the large viewing angle of the liquid crystal display device cannot be peep-proof, and the existing liquid crystal display device has a single viewing angle mode, so that the convenience of display of the liquid crystal display device is reduced.

SUMMARY OF THE APPLICATION

Therefore, in order to solve the technical problem that the viewing angle mode is single and the display convenience of the liquid crystal display device is low in the conventional art, a viewing angle mode switching method of the liquid crystal display device is proposed, which can switch between different viewing angle modes and improve the display convenience of the liquid crystal display device.

A viewing angle mode switching method of a liquid crystal display device. The liquid crystal display device comprises a plurality of scanning lines, a plurality of data lines, and a plurality of sub pixels. The sub pixels comprise a main pixel unit, a sub pixel unit, and a shared discharge unit. The main pixel unit and the sub pixel unit are configured to receive a first scanning signal of a first scanning line and further receive a first data signal of a first data line. The shared discharge unit is configured to receive a second scanning signal of a second scanning line which is adjacent to the first scanning line. The method comprises:

A viewing angle mode switching request is received. The viewing angle mode switching request comprises a target viewing angle mode. The target view mode is a first viewing angle mode or a second viewing angle mode.

A timing relationship between the second scanning signal and the first scanning signal is adjusted, according to the viewing angle mode switching request. The timing relationship comprises a first timing relationship corresponding to the first viewing angle mode, and a second timing relationship and a third timing relationship corresponding to the second viewing angle mode.

The liquid crystal display device is instructed to switch between the first viewing angle mode and the second viewing angle mode, according to a change of the timing relationship between the second scanning signal and the first scanning signal.

Besides, in order to solve the technical problem that the viewing angle mode is single and the display convenience of the liquid crystal display device is low in the conventional art, a liquid crystal display device is proposed, which can switch between different viewing angle modes and improve the display convenience of the liquid crystal display device.

A liquid crystal display device comprises a plurality of scanning lines, a plurality of data lines, and a plurality of sub pixels. The sub pixels comprise a main pixel unit, a sub pixel unit, and a shared discharge unit. The main pixel unit and the sub pixel unit are configured to receive a first scanning signal of a first scanning line and further receive a first data signal of a first data line, so as to have a first potential. The shared discharge unit is configured to receive a second scanning signal of a second scanning line which is adjacent to the first scanning line, so as to receive a discharge of the sub pixel unit and have a second potential the same as the sub pixel unit. The liquid crystal display device further comprises:

A request receiving unit for receiving a viewing angle mode switching request. The viewing angle mode switching request comprises a target viewing angle mode, the target view mode is a first viewing angle mode or a second viewing angle mode.

A timing adjusting unit for adjusting a timing relationship between the second scanning signal and the first scanning signal, according to the viewing angle mode switching request. The timing relationship comprises a first timing relationship corresponding to the first viewing angle mode, and a second timing relationship and a third timing relationship corresponding to the second viewing angle mode.

A mode switching unit for instructing the liquid crystal display device to switch between the first viewing angle mode and the second viewing angle mode, according to a change of the timing relationship between the second scanning signal and the first scanning signal.

Implementing the embodiments of the present invention, the beneficial effects are as following:

A viewing angle mode switching request is received. The viewing angle mode switching request comprises a target viewing angle mode. The target view mode is a first viewing angle mode or a second viewing angle mode. A timing relationship between the second scanning signal and the first scanning signal is adjusted, according to the viewing angle mode switching request. The timing relationship comprises a first timing relationship corresponding to the first viewing angle mode, and a second timing relationship and a third timing relationship corresponding to the second viewing angle mode. The liquid crystal display device is instructed to switch between the first viewing angle mode and the second viewing angle mode, according to a change of the timing relationship between the second scanning signal and the first scanning signal. It can be seen that according to the mode switching request, switch between different viewing modes can be achieved, and the display convenience of the liquid crystal display device can be improved.

BRIEF DESCRIPTION OF THE DRAWINGS

In order to describe the technical solutions in the embodiments of the present application or in the conventional art more clearly, the accompanying drawings required for describing the embodiments or the conventional art are briefly introduced. Apparently, the accompanying drawings in the following description only show some embodiments of the present application. For those skilled in the art, other drawings may be obtained based on these drawings without any creative work.

DETAILED DESCRIPTION OF THE PREFERRED EMBODIMENTS

The technical solutions in the embodiments of the present invention will be described clearly and completely hereinafter with reference to the accompanying drawings in the embodiments of the present invention. Apparently, the described embodiments are some but not all embodiments of the present invention. All other embodiments obtained by a person of ordinary skill in the art based on the embodiments of the present invention without creative efforts shall fall within the protection scope of the present invention.

In order to solve the technical problem that the viewing angle mode is single and the display convenience of the liquid crystal display device is low in the conventional art, a viewing angle mode switching method of the liquid crystal display device and a liquid crystal display device are proposed, which can switch between different viewing angle modes and improve the display convenience of the liquid crystal display device. The implementation of this method may rely on a computer program that runs on a Von Neumann-based computer system.

Figure 1:
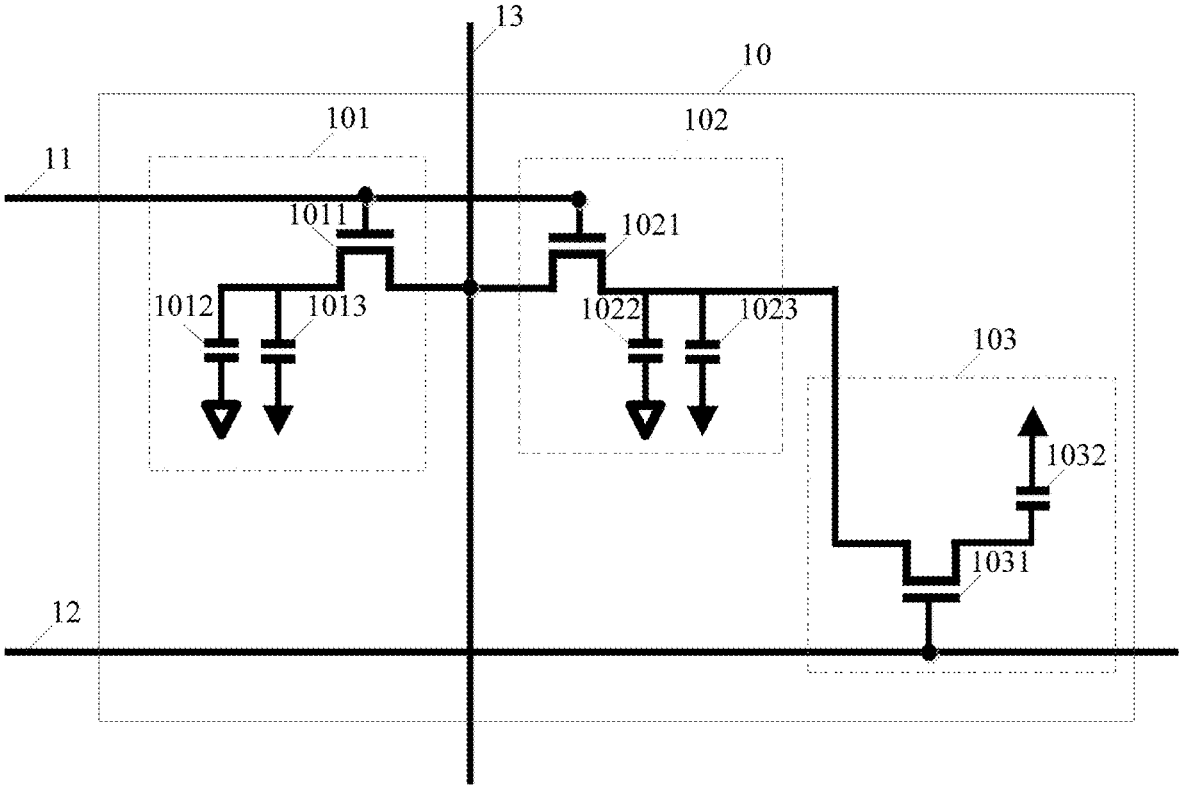
FIG. 1 is a schematic diagram of a pixel structure of a liquid crystal display device according to an embodiment of the present invention.

In order to better understand the viewing angle mode switching method of the liquid crystal display device disclosed in the embodiment of the present invention, the diagram of the pixel structure of the liquid crystal display device used in the embodiment of the present invention is described below. Please refer to FIG. 1, which is a schematic diagram of a pixel structure of a liquid crystal display device according to an embodiment of the present invention. As shown in FIG. 1, the pixel structure diagram may comprise a sub pixel 10, a first scanning line 11, a second scanning line 12 adjacent to the first scanning line 11, and a first data line 13. The sub pixel 10 may comprise a main pixel unit 101, a sub pixel unit 102 and a shared discharge unit 103. Further, the main pixel unit 101 may comprise a main thin film transistor 1011, a main pixel capacitor 1012, and a main storage capacitor 1013. Similarly, the sub pixel unit 102 may comprise a sub thin film transistor 1021, a sub pixel capacitor 1022, and a sub storage capacitor 1023. The shared discharge unit 103 may comprise a shared thin film transistor 1031 and a shared capacitor 1032. The main pixel unit 101 and the sub pixel unit 102 are configured to receive the first scanning signal of the first scanning line 11 and further receive the first data signal of the first data line 13. The shared discharge unit 103 is configured to receive a second scanning signal of the second scanning line 12 adjacent to the first scanning line 11. The liquid crystal display device may comprise a plurality of scanning lines, a plurality of data lines, and a plurality of sub pixels.

Figure 2:
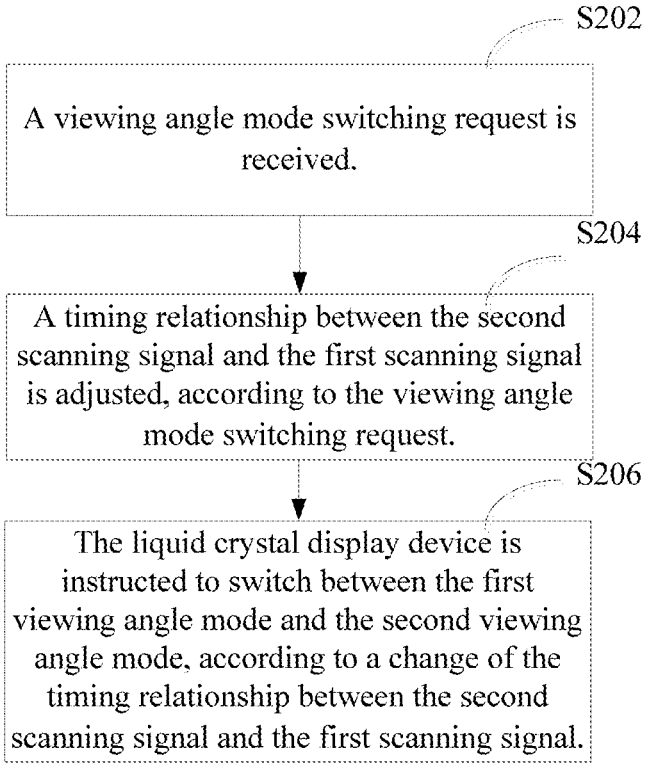
FIG. 2 is a flow chart of a viewing angle mode switching method of a liquid crystal display device according to an embodiment of the present invention.

Based on the pixel structure as shown in FIG. 1. Please refer to FIG. 2, which is a flow chart of a viewing angle mode switching method of a liquid crystal display device according to an embodiment of the present invention. The viewing angle mode switching method of the liquid crystal display device is described from the viewpoint of the liquid crystal display device. As shown in FIG. 2, the viewing angle mode switching method of the liquid crystal display device may comprise the following steps:

Step S202: a viewing angle mode switching request is received.

In the embodiment, the viewing angle mode switching request comprises a target viewing angle mode. The target view mode is a first viewing angle mode or a second viewing angle mode. The first viewing angle mode is a large viewing angle mode, in which the viewing angle range is broadened, and the real and clear images can be viewed at any viewing angle. The second viewing angle mode is a peek prevention mode, compared with the first viewing angle mode, in this mode, the viewing angle is narrower, and the viewing angle can be clearly seen within a certain angle so that the privacy of the viewer can be protected. The viewing angle mode switching request may be triggered by the user through a specific operation. For example, when a specified function button "switch to a peek prevention mode" is touched on the touch screen, a mode switching request is triggered to be sent to the liquid crystal display device. In the request, the target viewing angle mode comprises the second viewing angle mode, ie the peek prevention mode.

Step S204: a timing relationship between the second scanning signal and the first scanning signal is adjusted, according to the viewing angle mode switching request.

In the embodiment, the timing relationship comprises a first timing relationship corresponding to the first viewing angle mode, and a second timing relationship and a third timing relationship corresponding to the second viewing angle mode.

In the embodiment, the first timing relationship comprises that the first scanning signal leads the second scanning signal and that an effective level of the first scanning signal and an effective level of the second scanning signal do not overlap.

Specifically, the effective level of the first scanning signal may lead the effective level of the second scanning signal, ie, the main thin film transistor and the slave thin film transistor operate prior to the shared thin film transistor. When the thin film transistors are N-type thin film transistors, the effective level may be high level; when the thin film transistors are P type thin film transistors, the effective level may be low level. And the effective level duration of the first scanning signal does not overlap with the effective level duration of the second scanning signal.

In the embodiment, the main pixel unit and the sub pixel unit receive the first data signal and have a first potential during an effective level duration of the first scanning signal, and the shared discharge unit receives a discharge of the sub pixel unit and has a second potential the same as the sub pixel unit during the effective level duration of the second scanning signal, the liquid crystal display device operates in the first viewing angle mode.

Figure 3:
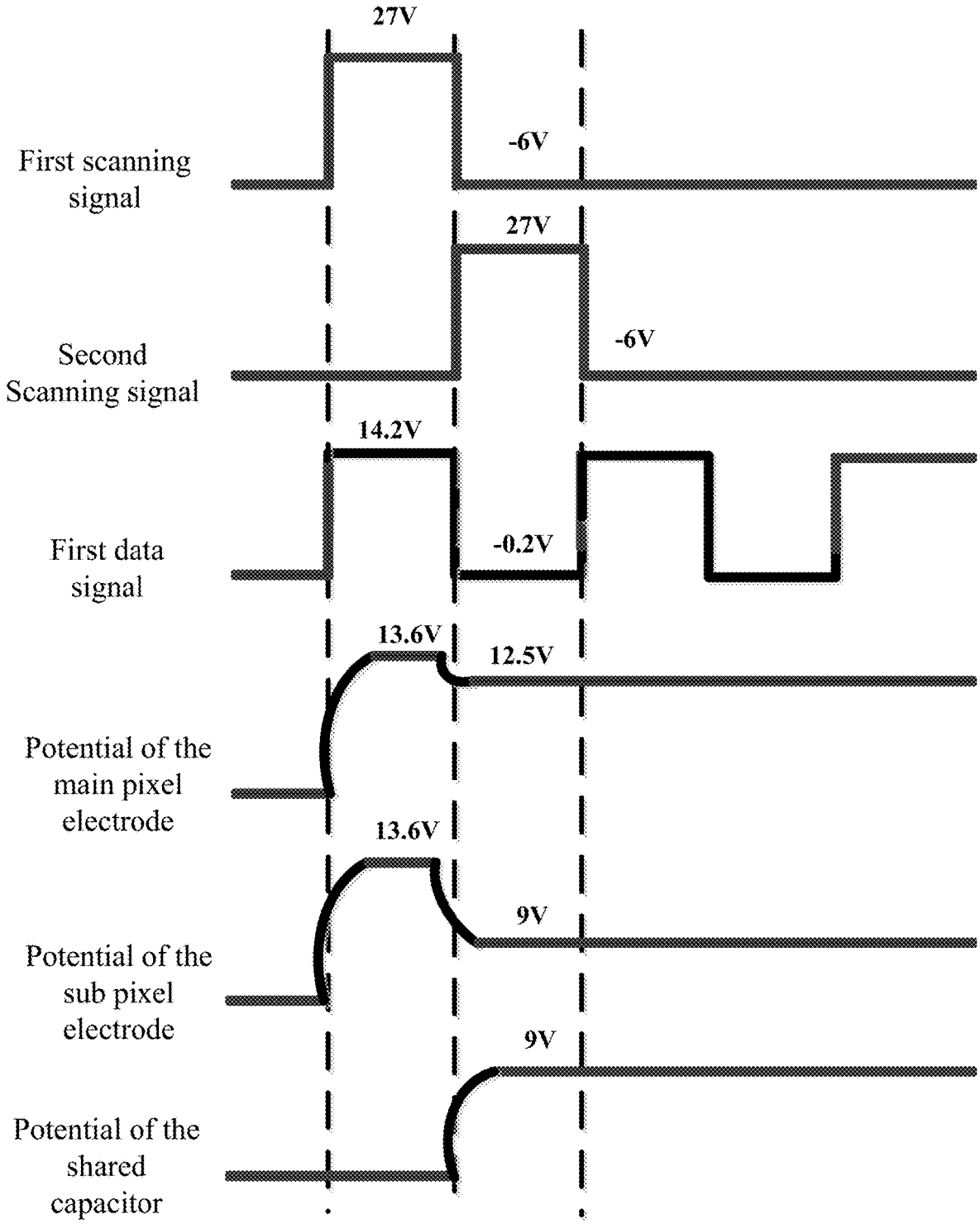
FIG. 3 is a schematic diagram of a timing relationship of a large viewing angle mode according to an embodiment of the present invention.

Please refer to FIG. 3, which is a schematic diagram of a timing relationship of a large viewing angle mode according to an embodiment of the present invention. As shown in FIG. 3, when the first scanning signal is at the effective level, that is, a potential of the first scanning signal is 27V, the gates of the main thin film transistor and the slave thin film transistor receive the effective level, so as to be turned on. Meanwhile, the first data signal is also at an effective level, such as a high level of 14.2V, and charges the main pixel electrode (including the main pixel capacitor and the main storage capacitor) of the main thin film transistor through the first data signal, and the sub pixel electrodes (including the sub pixel capacitor and the sub storage capacitor) of the sub thin film transistor. After a certain period of time, the capacitors are charged. The potentials of the main pixel electrode and the sub pixel electrode are the same as the first data signal, ie 13.6V. After the effective level of the first scanning signal is completed, the effective level of the second scanning signal appears immediately, the effective level of the first data signal is ended, and the gate of the shared thin film transistor receives an effective level at this time, so as to be turned on. The sub pixel electrode and the shared capacitor are conducted, so as to charge the shared capacitor, so that the potential of the sub pixel electrode is reduced to be lower than the main pixel electrode, the potential of the sub pixel electrode is 9V and the potential of the main pixel electrode is decreased due to the capacitive coupling effect, the potential of the main pixel electrode is 12.5 V. When the potential of the main pixel electrode is the same as the potential of the sub pixel electrode, the orientation of the liquid crystals in the corresponding position of the liquid crystal display device shows in four directions. Since the potential of the main pixel electrode and the potential of the sub pixel electrode in the pixels of the panel are different, the orientation of the liquid crystals in the corresponding position of the device shows in eight directions, and the increase the orientation of the liquid crystals, so as to reduce the difference of the average refractive index of the liquid crystal molecules in different viewing directions, thereby compensating the viewing angle.

In the embodiment, the second timing relationship comprises that the first scanning signal leads the second scanning signal and that an effective level of the first scanning signal and an effective level of the second scanning signal partially overlap.

Specifically, the effective level of the first scanning signal may lead the effective level of the second scanning signal, that is, the main thin film transistor and the sub thin film transistor operate prior to the shared thin film transistor; and the effective level of the first scanning signal and the effective level of the second scanning signal partially overlap, that is, the main thin film transistor, the sub thin film transistor, and the shared thin film transistor are turned on at the same time, after the main thin film transistor and the sub thin film transistor are turned on for a certain period of time.

In the embodiment, an overlap time of the first scanning signal and the second scanning signal is greater than half of an effective level duration of the first scanning signal and less than the effective level duration of the first scanning signal.

In the embodiment, the main pixel unit and the sub pixel unit receive the first data signal and have a first potential during an effective level duration of the first scanning signal, and the shared discharge unit receives a discharge of the sub pixel unit and has the first potential the same as the main pixel unit and the sub pixel unit during an effective level duration of the first scanning signal and the second scanning signal. The main pixel unit, the sub pixel unit, and the shared discharge unit all have a third potential when the first scanning signal is ineffective and during an effective level duration of the second scanning signal. The liquid crystal display device operates in the second viewing angle mode.

Figure 4A:
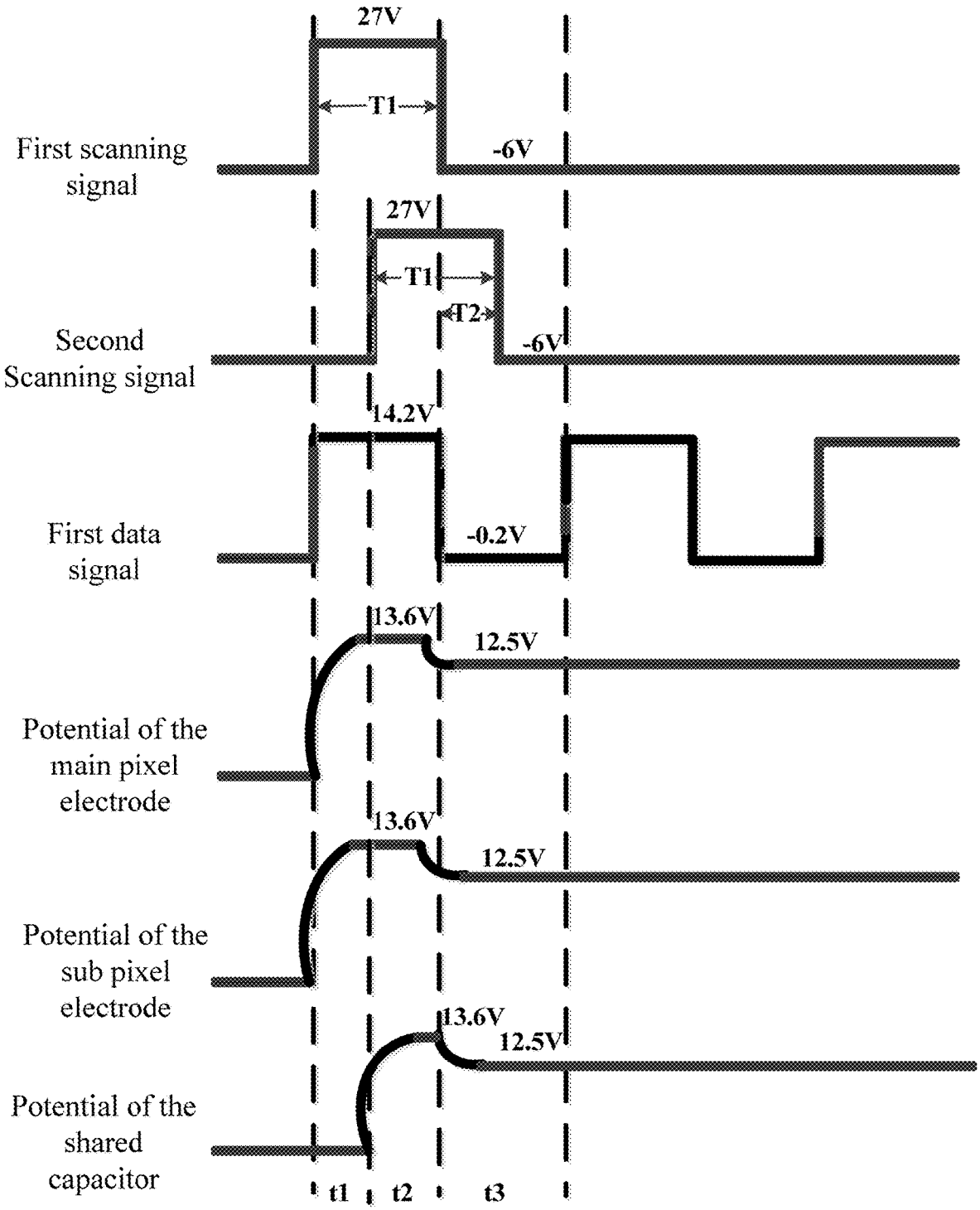
FIG. 4A is a schematic diagram of a timing relationship of a peek prevention mode according to an embodiment of the present invention.

Specifically, please refer to FIG. 4A, which is a schematic diagram of a timing relationship of a peek prevention mode according to an embodiment of the present invention. As shown in FIG. 4A, the description is divided into three time segments: in a duration t1, the first scanning signal is at the effective level, that is, the potential of the first scanning signal is 27V, the gate electrodes of the main thin film transistor and the sub thin film transistor receive the effective level, so as to be turned on. Since the second scanning signal is ineffective, the shared thin film transistor is turned off. At this time, the first data signal is also at an effective level, such as a high potential of 14.2V, the data signal is charged to the main pixel electrode (including the main pixel capacitor and the main storage capacitor) through the main thin film transistor and also charged to the sub pixel electrode (including the sub pixel capacitor and the sub storage capacitor) through the sub thin film transistor. After a certain period of time, the charging of the capacitor is completed. For example, the potentials of the main pixel electrode and the sub pixel electrode are the same with the high level of the first data signal as 13.6V and remain unchanged. In a duration t2, the first scanning signal maintains the effective level, the main thin film transistor and the sub thin film transistor remain on, and the first data signal is still in the effective state. At the same time, the second scanning signal is turned into an effective level to turn on the shared thin film transistor. At this time, the sub pixel electrode is conducted with the shared capacitor and charges to the shared capacitor. The first data signal charges the main pixel electrode and the sub pixel electrode at the same time, so that the pixel electrode and the sub pixel electrode have a potential equivalent to that of the first data signal. When the duration t2 is sufficiently long, the shared capacitor can be fully charged, that is, the overlapping time of the first scanning signal and the second scanning signal is sufficiently long. In order to satisfy the above conditions, for example, as shown in FIG. 4A, t2/t1 are generally required to be between 0.5 and 1. In a duration t3, the shared thin film transistor is fully charged, that is, the main thin film transistor and the sub thin film transistor are both in off state; the shared thin film transistor is in on state, that is, the sub pixel electrode is conducted with the shared capacitor, and the sub pixel capacitor does not charge to the shared capacitor. Therefore, the potentials of the main pixel electrode and the sub pixel electrode remain the same, and the orientation of the liquid crystals in the corresponding position of the liquid crystal display device shows in 4 directions; comparing with the large viewing angle mode, the orientation of the liquid crystals shows in eight directions, the orientation of liquid crystals is decreased, so as to increase the difference of the average refractive index of the liquid crystal molecules in different viewing directions, i.e., a side visual effect is suppressed in order to achieve the second viewing angle mode, i.e., the peek prevention mode.

In the embodiment, the third timing relationship comprises that the second scanning signal leads the first scanning signal and that an effective level of the first scanning signal and an effective level of the second scanning signal do not overlap.

Specifically, the effective level of the second scanning signal may lead the effective level of the first scanning signal, that is, the shared thin film transistor is turned on prior to the main thin film transistor and the sub thin film transistor; the effective level of the first scanning signal and the effective level of the second scanning signal do not overlap, that is, the shared thin film transistor is turned on in the effective level, the main thin film transistor and the sub thin film transistor are turned off; then, the shared thin film transistor is turned off, and the main thin film transistor and the sub thin film transistor are turned on.

In the embodiment, the main pixel unit and the sub pixel unit receive the first data signal and have a first potential during an effective level duration of the first scanning signal; the main pixel unit and the sub pixel unit both have a third potential when the first scanning signal is ineffective and the second scanning signal is ineffective, the liquid crystal display device operates in the second viewing angle mode.

Figure 4B:
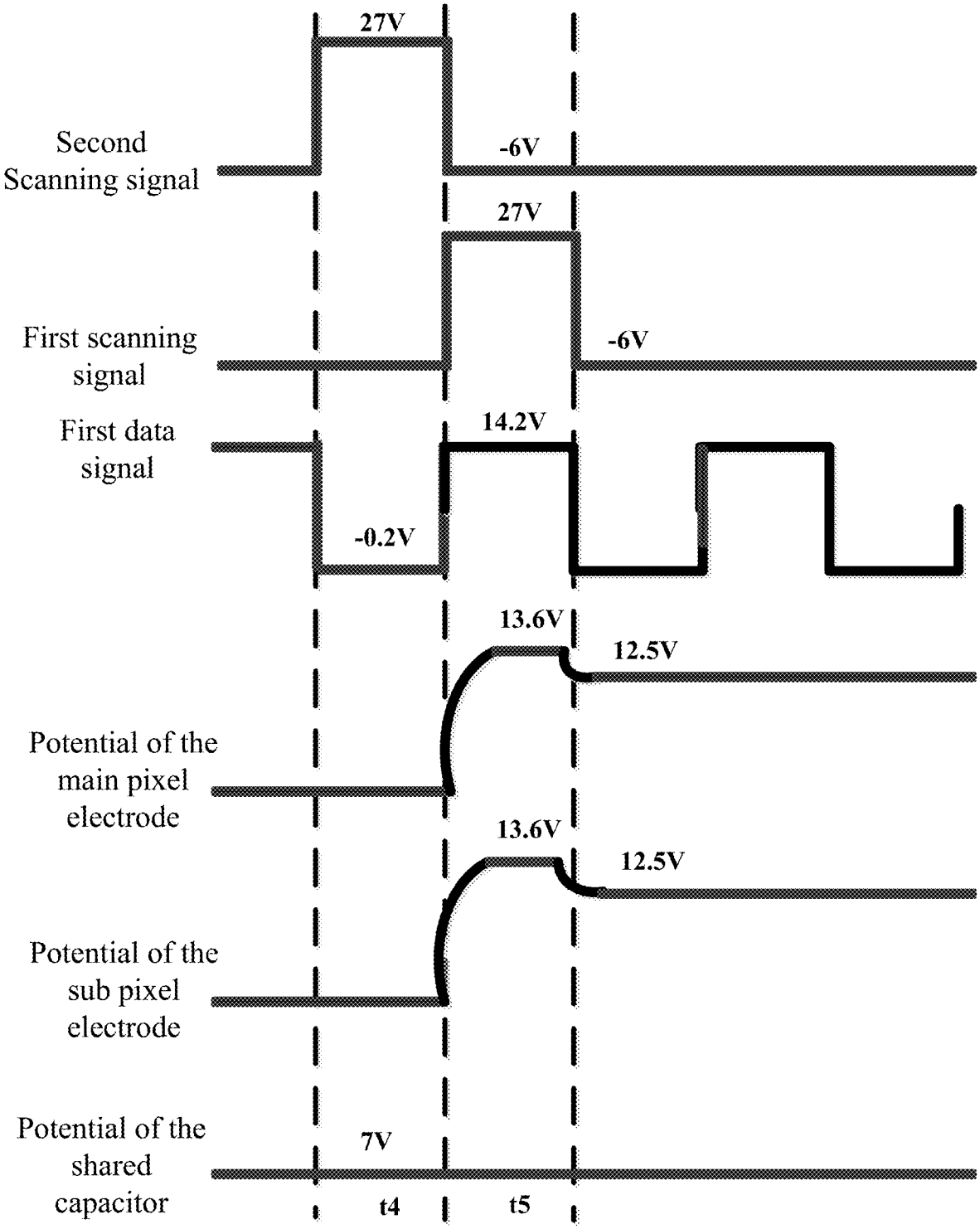
FIG. 4B is another schematic diagram of a timing relationship of peek prevention mode according to an embodiment of the present invention.

Specifically, please refer to FIG. 4B, which is another schematic diagram of a timing relationship of peek prevention mode according to an embodiment of the present invention. As shown in FIG. 4B, the description is divided into two time segments: during a duration t4, the second scanning signal is effective, the first scanning signal is ineffective, or both the first scanning signal and the second scanning signal are ineffective, and the first data signal is ineffective. Meanwhile, the shared thin film transistor is turned on, the main thin film transistor and the sub thin film transistor are turned off, and no power is applied to the main pixel electrode, the sub pixel electrode and the shared capacitor. In a duration t5, the first scanning signal is effective, and the second scanning signal is ineffective, and the first data signal is effective, the main thin film transistor and the sub thin film transistor are turned on, the shared thin film transistor is turned off, the first data signal charges the main pixel electrode and the sub pixel electrode, the shared capacitor is disconnected from the sub pixel electrode. Therefore, the potentials of the main pixel electrode and the sub pixel electrode remain the same, and the orientation of the liquid crystals in the corresponding position of the liquid crystal display device shows in 4 directions; comparing with the large viewing angle mode, the orientation of the liquid crystals shows in eight directions, the orientation of liquid crystals is decreased, so as to increase the difference of the average refractive index of the liquid crystal molecules in different viewing directions, i.e., a side visual effect is suppressed in order to achieve the second viewing angle mode, i.e., the peek prevention mode.

In the embodiment, a connection between the sub pixel unit and the shard discharge unit can be modified, so as to switch the liquid crystal display device from the first viewing angle mode to the second viewing angle mode.

Figure 5:
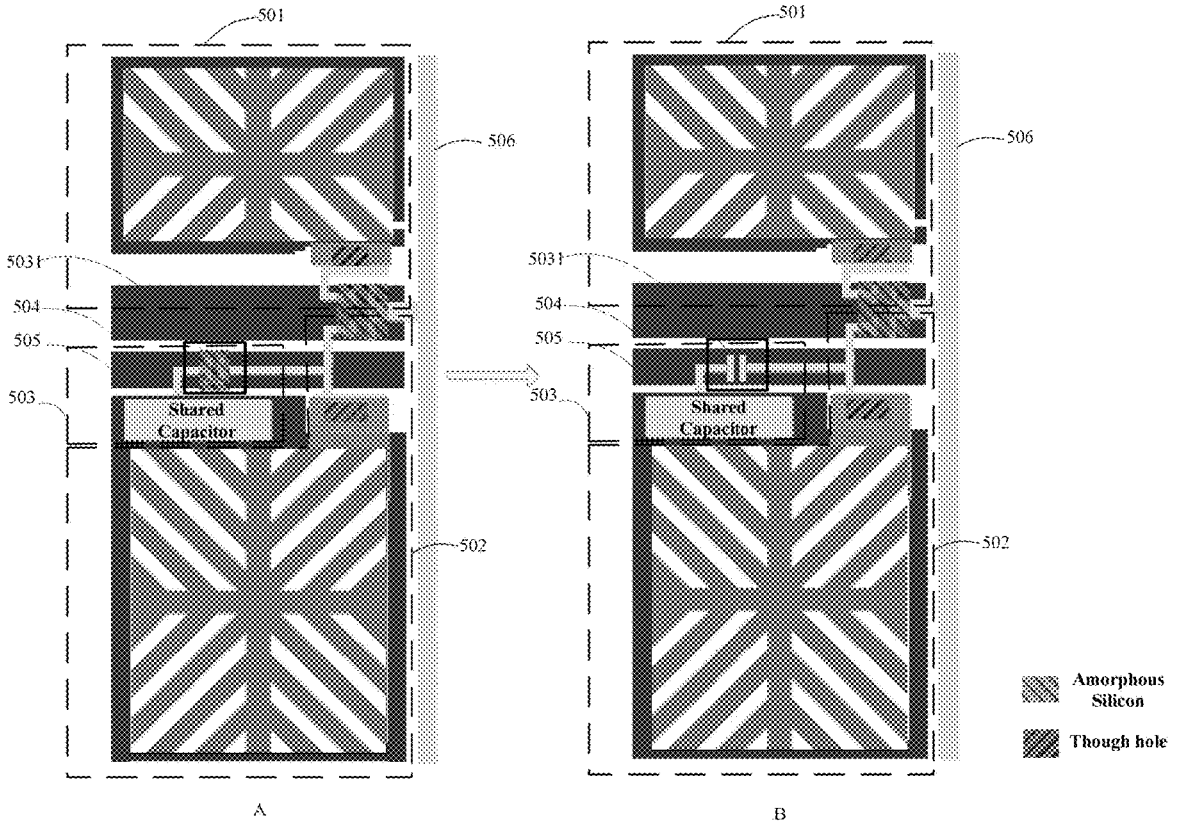
FIG. 5 is a schematic layout according to an embodiment of the present invention.

Specifically, please refer to FIG. 5, which is a schematic layout according to an embodiment of the present invention. As shown in FIG. 5, in this layout, a dotted frame 501 partially implements a main pixel unit, 502 implements a sub pixel unit, 503 implements a shared discharge unit 503, 504 implements a first scanning line, 505 implements a second scanning line, and 506 implements a first data line. The main pixel electrode and the sub pixel electrode are implemented by a region of "米" shape in the schematic diagram, and are implemented by using indium tin oxide (ITO). In the thin film transistor, the amorphous silicon is a semiconductor layer for implementing the conduction of the transistor. When the amorphous silicon is removed, the thin film transistor is disconnected. In A of FIG. 5, a shared thin film transistor 5031 of a shared discharge unit in the solid, which can implement the structure diagram of the pixel shown in FIG. 1 and can work in the first viewing angle mode, that is, the large viewing angle mode, a sub pixel electrode under the control of a data line; on the basis of A in FIG. 5, the amorphous silicon layer of the shared thin film transistor 5031 in a solid frame, which can implements the diagram of the pixel structural shown in FIG. 1 and work in the first viewing angel mode, that is, the large viewing angle mode, and conducted with the sub pixel electrode under the control of the first data line; on the basis of A in FIG. 5, the amorphous silicon layer of the shared thin film transistor 5031 in the solid frame can be removed, the shared capacitor is disconnected from the sub pixel electrode, the sub pixel electrode does not discharge the shared capacitor, and the potentials of the main pixel electrode and the sub pixel electrode potential remain the same, so as to realize the second viewing angle mode, that is, the peek prevention mode. Also, by modifying the mask, the connection and disconnection between the shared discharge unit and the sub pixel electrode can also be realized, and the second viewing angle mode can be realized on the layout.

Step S206: the liquid crystal display device is instructed to switch between the first viewing angle mode and the second viewing angle mode, according to a change of the timing relationship between the second scanning signal and the first scanning signal.

In the viewing angle mode switching method of a liquid crystal display device shown in FIG. 2, a viewing angle mode switching request is received. The viewing angle mode switching request comprises a target viewing angle mode. The target view mode is a first viewing angle mode or a second viewing angle mode. A timing relationship between the second scanning signal and the first scanning signal is adjusted, according to the viewing angle mode switching request. The timing relationship comprises a first timing relationship corresponding to the first viewing angle mode, and a second timing relationship and a third timing relationship corresponding to the second viewing angle mode. The liquid crystal display device is instructed to switch between the first viewing angle mode and the second viewing angle mode, according to a change of the timing relationship between the second scanning signal and the first scanning signal. It can be seen that according to the mode switching request, switch between different viewing modes can be achieved, and the display convenience of the liquid crystal display device can be improved.

Figure 6:
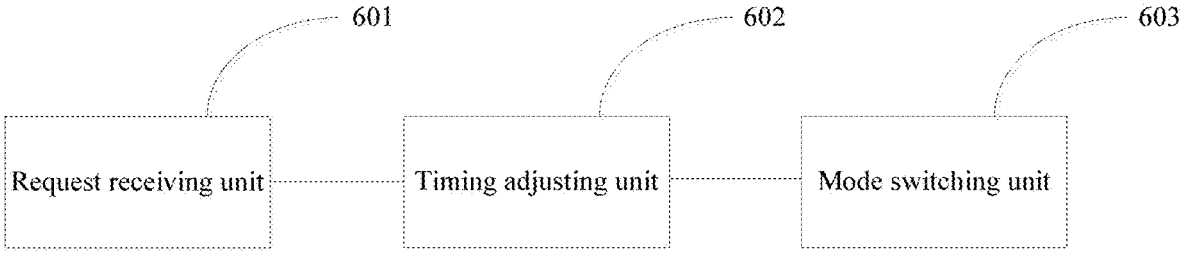
FIG. 6 is a schematic structural diagram of a liquid crystal display device according to an embodiment of the present invention.

Besides, in order to solve the technical problem that the viewing angle mode is single and the display convenience of the liquid crystal display device is low in the conventional art, a liquid crystal display device is proposed in one embodiment. Please refer to FIG. 6, which is a schematic structural diagram of a liquid crystal display device according to an embodiment of the present invention. The schematic structural diagram of the liquid crystal display device can comprise FIG. 1. As shown in FIG. 1, the device comprises a plurality of scanning lines, a plurality of data lines, and a plurality of sub pixels. The sub pixels comprise a main pixel unit 101, a sub pixel unit 102, and a shared discharge unit 103. The main pixel unit 101 and the sub pixel unit 102 are configured to receive a first scanning signal of a first scanning line and further receive a first data signal of a first data line, so as to have a first potential. The shared discharge unit 103 is configured to receive a second scanning signal of a second scanning line which is adjacent to the first scanning line, so as to receive a discharge of the sub pixel unit 102 and have a second potential the same as the sub pixel unit 102. As shown in FIG. 6, the liquid crystal display device further comprises:

A request receiving unit 601 for receiving a viewing angle mode switching request. The viewing angle mode switching request comprises a target viewing angle mode, the target view mode is a first viewing angle mode or a second viewing angle mode.

A timing adjusting unit 602 for adjusting a timing relationship between the second scanning signal and the first scanning signal, according to the viewing angle mode switching request. The timing relationship comprises a first timing relationship corresponding to the first viewing angle mode, and a second timing relationship and a third timing relationship corresponding to the second viewing angle mode.

A mode switching unit 603 for instructing the liquid crystal display device to switch between the first viewing angle mode and the second viewing angle mode, according to a change of the timing relationship between the second scanning signal and the first scanning signal.

As one possible embodiment, the first timing relationship comprises that the first scanning signal leads the second scanning signal and that an effective level of the first scanning signal and an effective level of the second scanning signal do not overlap.

The second timing relationship comprises that the first scanning signal leads the second scanning signal and that an effective level of the first scanning signal and an effective level of the second scanning signal partially overlap.

The third timing relationship comprises that the second scanning signal leads the first scanning signal and that an effective level of the first scanning signal and an effective level of the second scanning signal do not overlap.

In the liquid crystal display device in FIG. 6, a viewing angle mode switching request is received. The viewing angle mode switching request comprises a target viewing angle mode. The target view mode is a first viewing angle mode or a second viewing angle mode. A timing relationship between the second scanning signal and the first scanning signal is adjusted, according to the viewing angle mode switching request. The timing relationship comprises a first timing relationship corresponding to the first viewing angle mode, and a second timing relationship and a third timing relationship corresponding to the second viewing angle mode. The liquid crystal display device is instructed to switch between the first viewing angle mode and the second viewing angle mode, according to a change of the timing relationship between the second scanning signal and the first scanning signal. It can be seen that according to the mode switching request, switch between different viewing modes can be achieved, and the display convenience of the liquid crystal display device can be improved.

Figure 7:
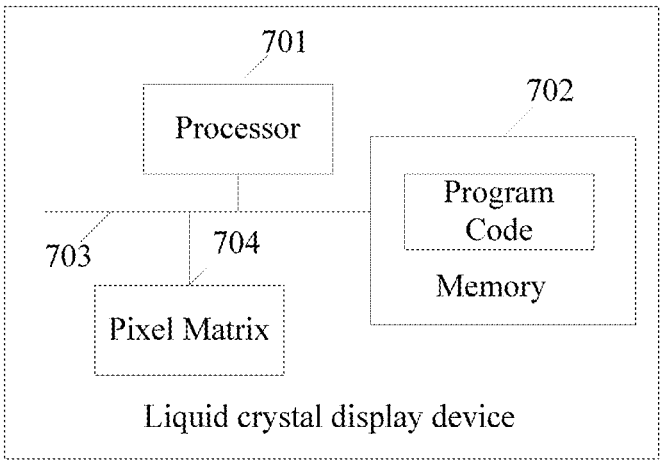
FIG. 7 is another schematic structural diagram of a liquid crystal display device according to an embodiment of the present invention.

Based on the pixel structure shown in FIG. 1, please refer to FIG. 7, which is another schematic structural diagram of a liquid crystal display device according to an embodiment of the present invention. As shown in FIG. 7, the liquid crystal display device may comprise at least one processor 701 (such as a CPU), a memory 702, at least one communication bus 703, and a pixel matrix 704. The communication bus 703 is used to implement connecting communication between these components. The memory 702 may be a high-speed RAM memory and may also be a non-volatile memory (such as at least one disk memory). The memory 702 may optionally comprise at least one storage device located away from the processor 701. The structure of a single pixel in the pixel matrix 704 is the same as that of the pixel structure shown in FIG. 1.

The processor 701 is configured to invoke the program code stored in the memory 702 to perform the following operations:

A viewing angle mode switching request is received. The viewing angle mode switching request comprises a target viewing angle mode. The target view mode is a first viewing angle mode or a second viewing angle mode.

A timing relationship between the second scanning signal and the first scanning signal is adjusted, according to the viewing angle mode switching request. The timing relationship comprises a first timing relationship corresponding to the first viewing angle mode, and a second timing relationship and a third timing relationship corresponding to the second viewing angle mode.

The liquid crystal display device is instructed to switch between the first viewing angle mode and the second viewing angle mode, according to a change of the timing relationship between the second scanning signal and the first scanning signal.

As one possible embodiment, the first timing relationship comprises that the first scanning signal leads the second scanning signal and that an effective level of the first scanning signal and an effective level of the second scanning signal do not overlap.

The second timing relationship comprises that the first scanning signal leads the second scanning signal and that an effective level of the first scanning signal and an effective level of the second scanning signal partially overlap.

The third timing relationship comprises that the second scanning signal leads the first scanning signal and that an effective level of the first scanning signal and an effective level of the second scanning signal do not overlap.

In the liquid crystal display device in FIG. 7, a viewing angle mode switching request is received. The viewing angle mode switching request comprises a target viewing angle mode. The target view mode is a first viewing angle mode or a second viewing angle mode. A timing relationship between the second scanning signal and the first scanning signal is adjusted, according to the viewing angle mode switching request. The timing relationship comprises a first timing relationship corresponding to the first viewing angle mode, and a second timing relationship and a third timing relationship corresponding to the second viewing angle mode. The liquid crystal display device is instructed to switch between the first viewing angle mode and the second viewing angle mode, according to a change of the timing relationship between the second scanning signal and the first scanning signal. It can be seen that according to the mode switching request, switch between different viewing modes can be achieved, and the display convenience of the liquid crystal display device can be improved.

Persons of ordinary skill in the art should understand that all or part of the steps in the methods in the foregoing embodiments may be implemented by instructing relevant hardware with a program. The program may be stored in a computer-readable storage medium, and the storage medium may comprise a flash drive, a read only memory (ROM), a random access memory (RAM), a magnetic disk, or an optical disk.

The viewing angle mode switching method of a liquid crystal display device and the liquid crystal display device according to the embodiments of the present invention are described in detail above. Specific examples are used herein to describe the principle and implementation manners of the present invention. The description of the foregoing embodiments is merely intended to help understanding of the present invention methods and core ideas thereof; meanwhile, those skilled in the art may make changes to the specific implementation manners and the application scope according to the ideas of the present invention. In view of the foregoing, the contents of the description should not be construed as a limitation of the present invention.

What is claimed is:

1. A viewing angle mode switching method of a liquid crystal display device, wherein the liquid crystal display device comprises a plurality of scanning lines, a plurality of data lines, and a plurality of sub pixels; the sub pixels comprise a main pixel unit, a sub pixel unit, and a shared discharge unit; the main pixel unit and the sub pixel unit are configured to receive a first scanning signal of a first scanning line and further receive a first data signal of a first data line, the shared discharge unit is configured to receive a second scanning signal of a second scanning line which is adjacent to the first scanning line, wherein the method comprises:

receiving a viewing angle mode switching request, the viewing angle mode switching request comprises a target viewing angle mode, wherein the target view mode is a first viewing angle mode or a second viewing angle mode;

adjusting a timing relationship between the second scanning signal and the first scanning signal, according to the viewing angle mode switching request, wherein the timing relationship comprises a first timing relationship corresponding to the first viewing angle mode, and a second timing relationship and a third timing relationship corresponding to the second viewing angle mode; and instructing the liquid crystal display device to switch between the first viewing angle mode and the second viewing angle mode, according to a change of the timing relationship between the second scanning signal and the first scanning signal; and wherein the second timing relationship comprises that the first scanning signal leads the second scanning signal and that an effective level of the first scanning signal and an effective level of the second scanning signal partially overlap;

wherein the main pixel unit and the sub pixel unit receive the first data signal and have a first potential during an effective level duration of the first scanning signal, and the shared discharge unit receives a discharge of the sub pixel unit and has the first potential the same as the main pixel unit and the sub pixel unit during an effective level duration of the first scanning signal and the second scanning signal; the main pixel unit, the sub pixel unit, and the shared discharge unit all have a third potential when the first scanning signal is ineffective and during an effective level duration of the second scanning signal, the liquid crystal display device operates in the second viewing angle mode.

2. The method according to claim 1, wherein the first timing relationship comprises that the first scanning signal leads the second scanning signal and that an effective level of the first scanning signal and an effective level of the second scanning signal do not overlap.

3. The method according to claim 2, wherein the main pixel unit and the sub pixel unit receive the first data signal and have a first potential during an effective level duration of the first scanning signal, and the shared discharge unit receives a discharge of the sub pixel unit and has a second potential the same as the sub pixel unit during the effective level duration of the second scanning signal, the liquid crystal display device operates in the first viewing angle mode.

4. The method according to claim 1, wherein an overlap time of the first scanning signal and the second scanning signal is greater than half of an effective level duration of the first scanning signal and less than the effective level duration of the first scanning signal.

5. The method according to claim 1, wherein the third timing relationship comprises that the second scanning signal leads the first scanning signal and that an effective level of the first scanning signal and an effective level of the second scanning signal do not overlap.

6. The method according to claim 1, wherein the main pixel unit and the sub pixel unit receive the first data signal and have a first potential during an effective level duration of the first scanning signal; the main pixel unit and the sub pixel unit both have a third potential when the first scanning signal is ineffective and the second scanning signal is ineffective, the liquid crystal display device operates in the second viewing angle mode.

7. The method according to claim 1, wherein the method further comprises:

modifying a connection between the sub pixel unit and the shard discharge unit, so as to switch the liquid crystal display device from the first viewing angle mode to the second viewing angle mode.

8. The method according to claim 2, wherein the method further comprises:

modifying a connection between the sub pixel unit and the shard discharge unit, so as to switch the liquid crystal display device from the first viewing angle mode to the second viewing angle mode.

9. The method according to claim 3, wherein the method further comprises:

modifying a connection between the sub pixel unit and the shard discharge unit, so as to switch the liquid crystal display device from the first viewing angle mode to the second viewing angle mode.

10. A liquid crystal display device, comprising a plurality of scanning lines, a plurality of data lines, and a plurality of sub pixels; the sub pixels comprise a main pixel unit, a sub pixel unit, and a shared discharge unit; the main pixel unit and the sub pixel unit are configured to receive a first scanning signal of a first scanning line and further receive a first data signal of a first data line, so as to have a first potential, the shared discharge unit is configured to receive a second scanning signal of a second scanning line which is adjacent to the first scanning line, so as to receive a discharge of the sub pixel unit and have a second potential the same as the sub pixel unit, wherein the liquid crystal display device further comprises a processor, wherein the processor is operable to receive a viewing angle mode switching request, wherein the viewing angle mode switching request comprises a target viewing angle mode, and the target view mode is a first viewing angle mode or a second viewing angle mode;

the processor is operable to adjust a timing relationship between the second scanning signal and the first scanning signal, according to the viewing angle mode switching request, wherein the timing relationship comprises a first timing relationship corresponding to the first viewing angle mode, and a second timing relationship and a third timing relationship corresponding to the second viewing angle mode; and the processor is operable to instruct the liquid crystal display device to switch between the first viewing angle mode and the second viewing angle mode, according to a change of the timing relationship between the second scanning signal and the first scanning signal, wherein the second timing relationship comprises that the first scanning signal leads the second scanning signal and that an effective level of the first scanning signal and an effective level of the second scanning signal partially overlap;

wherein the main pixel unit and the sub pixel unit receive the first data signal and have a first potential during an effective level duration of the first scanning signal, and the shared discharge unit receives a discharge of the sub pixel unit and has the first potential the same as the main pixel unit and the sub pixel unit during an effective level duration of the first scanning signal and the second scanning signal; the main pixel unit, the sub pixel unit, and the shared discharge unit all have a third potential when the first scanning signal is ineffective and during an effective level duration of the second scanning signal, the liquid crystal display device operates in the second viewing angle mode.

11. The liquid crystal display device according to claim 10, wherein the first timing relationship comprises that the first scanning signal leads the second scanning signal and that an effective level of the first scanning signal and an effective level of the second scanning signal do not overlap; and the third timing relationship comprises that the second scanning signal leads the first scanning signal and that an effective level of the first scanning signal and an effective level of the second scanning signal do not overlap.

* * * * *